US005662301A

United States Patent [19]

Fard

[11] Patent Number: 5,662,301

[45] Date of Patent: Sep. 2, 1997

[54] PRODUCT DISPLAY APPARATUS

[75] Inventor: Kambiz H. Fard, New York, N.Y.

[73] Assignee: Fila U.S.A., Inc., Sparks, Md.

[21] Appl. No.: 546,230

[22] Filed: Oct. 20, 1995

[51] Int. Cl.[6] ..... A47F 7/00

[52] U.S. Cl. ..... 248/315; 248/289.11; 248/309.1; 211/34; 211/35

[58] Field of Search ..... 248/200, 289.11, 248/292.12, 309.1, 315; 211/34, 35

[56] References Cited

U.S. PATENT DOCUMENTS

| | | | |
|---|---|---|---|
| D. 309,917 | 8/1990 | Beirise et al. . | |
| D. 320,332 | 10/1991 | Fetty . | |
| 2,412,847 | 12/1946 | Van Tilburg | 211/35 |
| 2,500,242 | 3/1950 | Denton | 211/35 X |
| 2,564,117 | 8/1951 | Lebovits | 211/35 X |
| 2,682,955 | 7/1954 | Moore | 211/35 |
| 2,931,513 | 4/1960 | Cignoli | 211/35 |
| 2,965,237 | 12/1960 | Wells | 211/35 |
| 3,532,225 | 10/1970 | Reed . | |
| 3,699,745 | 10/1972 | Reid . | |
| 4,109,335 | 8/1978 | Randolph | 211/35 X |
| 4,168,871 | 9/1979 | Dierkes | 211/34 X |
| 4,200,993 | 5/1980 | Blanc et al. | 211/34 X |
| 4,673,089 | 6/1987 | Chap . | |
| 4,779,743 | 10/1988 | McKinnon | 211/35 |
| 5,352,058 | 10/1994 | Munro et al. | 248/289.11 X |
| 5,516,073 | 5/1996 | McMahan | 248/289.11 X |
| 5,542,631 | 8/1996 | Bruno | 248/289.11 X |
| 5,547,157 | 8/1996 | Hsiao | 211/37 X |

*Primary Examiner*—Alvin C. Chin-Shue
*Assistant Examiner*—Richard M. Smith
*Attorney, Agent, or Firm*—Fish & Richardson P.C.

[57] ABSTRACT

A product display apparatus that is durable and versatile, and that advantageously displays a product is described. The device has a display support element and a product holder element. The display support element has a display bracket with at least one connection means for attachment to a display area surface, a display arm attached to the display bracket, and a connector. The product holder element has a second connector designed to removably mate with the first connector in different orientations, and a product holder means for supporting a product. A product may be displayed in a number of different orientations depending upon how the first and second connectors are aligned. In addition, the product holder element cradles a product under the force of gravity, which enables a consumer to easily remove and replace a product.

14 Claims, 3 Drawing Sheets

PRODUCT DISPLAY APPARATUS

BACKGROUND OF THE INVENTION

This invention relates to product displays in general, and more particularly to a device for displaying footwear.

In many retail shoe stores, and in department stores having shoe departments, articles of footwear are typically displayed on shelves or on pedestals attached to a display wall. Alternately, footwear are displayed on top of tables, counters and/or specially constructed display cabinets. Consumers typically approach the displays and remove one or more shoes for closer inspection when considering which style of footwear to purchase.

Many of the pedestal-type shoe display devices, designed for attachment to a wall, permit the retailer to display a shoe from one side only, in profile. Such displays thus severely limit the manner in which footwear are displayed. Further, many of these displays are comprised of a clear plastic material which is prone to cracking or chipping during use and/or over time. This leads to an unsightly display appearance unless the retailer regularly replaces the pedestal displays, which increases operating costs.

SUMMARY OF THE INVENTION

The present invention provides a display apparatus of novel construction for displaying a product. In particular, a novel display device for displaying an article of footwear is described. The device is durable and versatile, permitting a retailer to display an article of footwear at different angles. In addition, the device cradles a product under the force of gravity, which permits the easy removal and replacement of the product by a consumer wishing to more closely peruse the merchandise.

In accordance with the invention, a footwear display apparatus is comprised of two pieces, a support element and a product holder element. The support element has a display bracket with at least one connection means for attachment to a display area surface, a display arm attached to the display bracket, and a first connector. The product holder element has a second connector which removably mates with the first connector, and a product holder means for supporting a product. The product holder element may be connected o the support element in a plurality of ways, depending on the alignment of the first and second connectors, so that products may be displayed in a number of different orientations.

DETAILED DESCRIPTION

Figure 1:
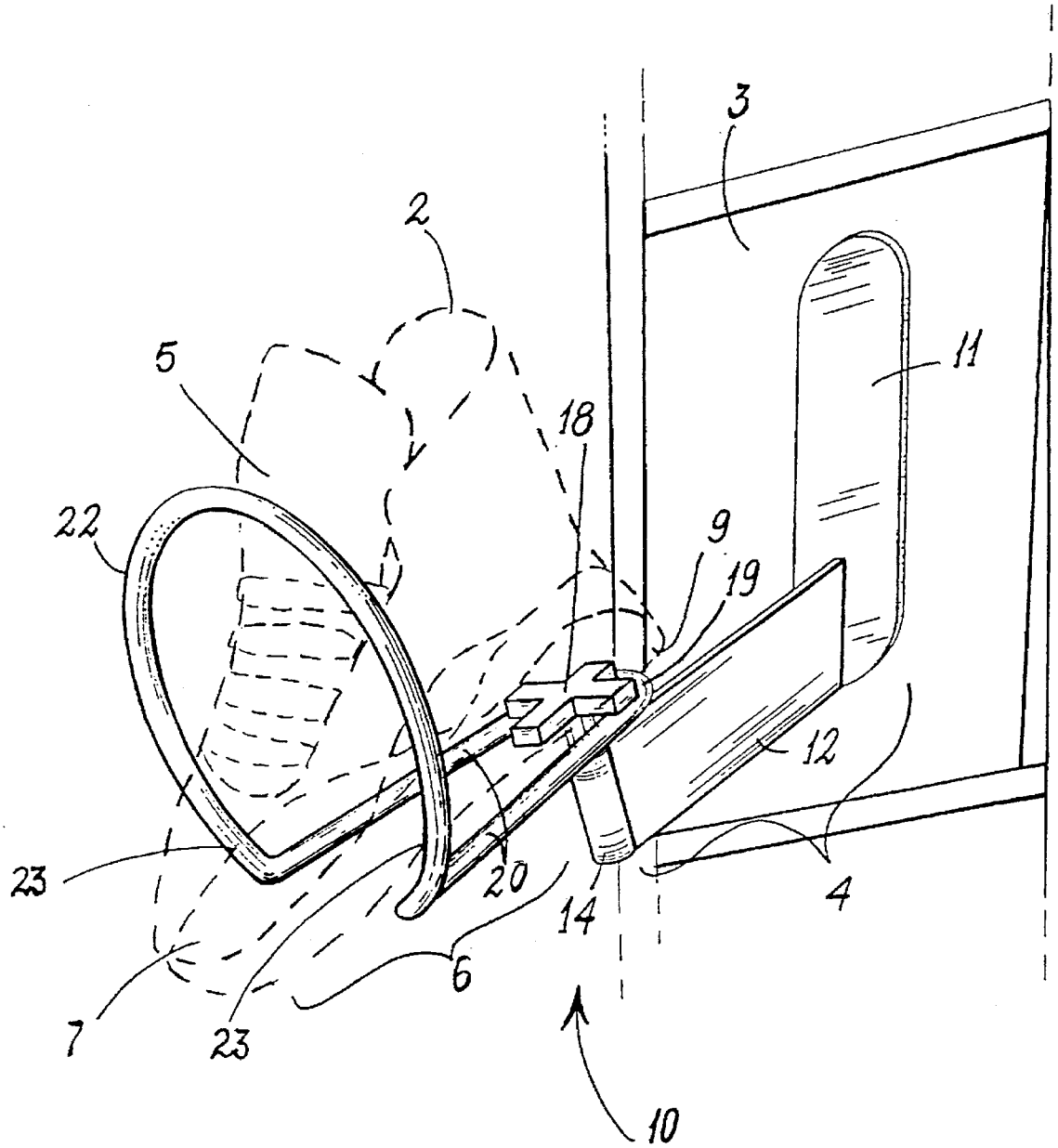
FIG. 1 is a perspective view of an embodiment of a product display apparatus according to the invention.

FIG. 1 is a perspective view of a first embodiment of a product display apparatus 10 according to the invention. The product display device 10 is preferably made of steel, aluminum, or other metal, but may also be comprised of a durable plastic, strong composite material or a combination of such materials. A shoe 2, drawn in phantom outline, illustrates how the product display apparatus 10 can be used to display a footwear product. The product is held in place under the force of gravity.

In FIG. 1, the product display apparatus 10 is attached to a moveable wall panel 3 that is part of a display wall. The display wall may contain a plurality of display apparatus 10 attached to a plurality of wall panels 3 to display a variety of products. It should be understood, however, that the product display apparatus 10 can also be attached to a stationary wall or to other display surfaces that may be part of a display area.

The product display apparatus 10 is comprised of two sections, a support element 4 and a holder element 6. The support element 4 attaches to, and projects outwardly from, the wall panel 3. The support element 4 angles downward approximately 45 degrees from the horizontal. The holder element 6 is removably connected to the support element 4 and, in the embodiment shown, supports an article of footwear. In particular, the toe section 7 of a shoe 2 is placed through a loop holder 22 which is generally perpendicular to a set of rods 20 of the holder element 6. The loop holder 22 contacts the shoe at the tongue section 5 of the upper, and at two points 23 on either side of the sole towards the front of the shoe. The heel portion 9 of the shoe sole rests on a cross-shaped support 18.

Figure 2:
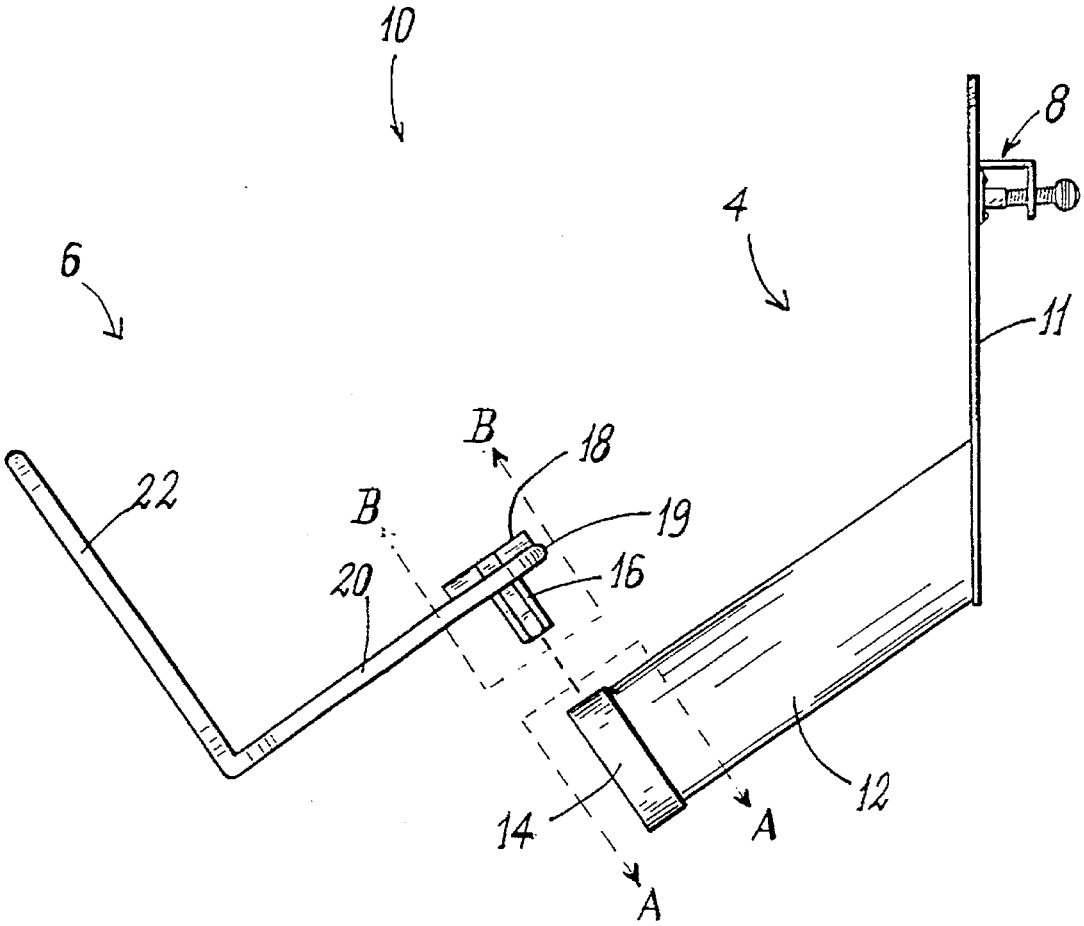
FIG. 2 is an exploded side view of the product display apparatus shown in FIG. 1.

FIG. 2 is an exploded side view of the product display apparatus 10 shown in FIG. 1, illustrating the support element 4 disconnected from the holder element 6. The support element 4 contains a clamping means 8 for attaching the product display apparatus 10 to a display wall or other display area. Although the clamping means 8 is depicted as comprising a bracket and a hand-turnable screw, one of skill in the art understands that many other attachment means, such as nut and bolt arrangements, spring clips, rivets and the like, could be used. The clamping means 8 and a display arm 12 are attached to a display bracket 11. The flat surface area of the display bracket 11 provides stability when the support element 4 is attached to a display surface (see FIG. 1). The end of the display arm 12 furthest from the display bracket 11 is terminated with a female connector member 14. The holder element 6 comprises a hex-shaped male connector 16 attached to a cross-shaped support 18 (see FIGS. 1 and 3C). The cross-shaped support 18 is connected to a rod holder means 19, which has a set of support rods 20 and terminates in a loop holder 22 (see FIG. 1). The loop holder 22 is approximately perpendicular to the support rods 20.

As shown in FIGS. 1 and 2, the product display apparatus 10 is designed to angle downward at approximately 45 degrees to the horizontal to hold a shoe under the force of gravity, and to display a shoe 2 to a consumer in a manner that promotes the design features of the upper. In particular, a shoe upper, including the tongue 5 and the toe area 7 can easily be discerned by a customer as she approaches the display. Further, the side areas of the shoe can also be easily seen because the footwear is extended outward from the display area. Yet further, a customer can easily remove a footwear product from the display apparatus 10 by grasping and pulling it upward and towards the display bracket 11, for closer inspection. The large circular opening of the loop holder 22 also permits easy replacement of the product on the display apparatus 10.

Figure 3A:
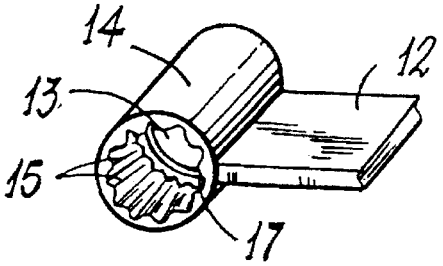
FIG. 3A is a top perspective view of a female connector taken along dotted lines A—A of FIG. 2.
Figure 3B:
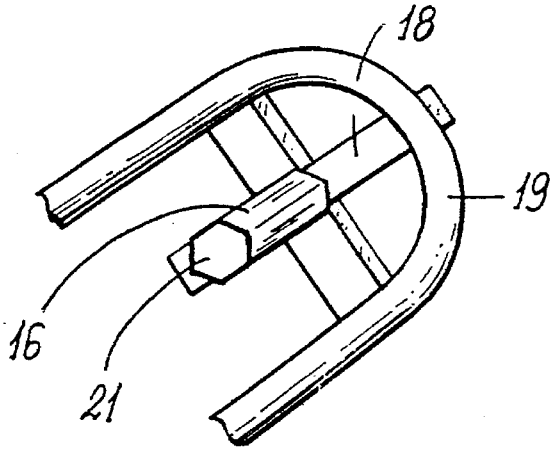
FIG. 3B is a bottom perspective view of a male connector taken along dotted lines B—B of FIG. 2.

FIG. 3A is a cutaway top perspective view taken along dotted lines A—A in FIG. 2 of the female connector 14 of the support element 4. The female connector 14 has an opening 13 having an inside wall that is machined to contain a plurality of parallel ridges 15 that extend downwards inside the connector to a base 17. The parallel ridges 15 are spaced apart to mate with a hex-shaped male connector in a plurality of orientations. The base 17 provides a stop point for a male connector at a predetermined length of penetration of the connector 14. FIG. 3B is a cutaway bottom perspective view taken along dotted lines B—B in FIG. 2 of the male connector 16 of the holder element 6. In FIG. 3B, the connector 16 is hex-shaped and is attached to cross-shaped support 18 which is attached to the rod holder means 19. As can be easily appreciated, such a connector design permits attachment of the holder element 6 to the support element 4 in a plurality of orientations. One of skill in the art understands that the male connector need not be restricted to being of a hex-shaped design to accomplish the same effect, and that other shapes could be used to define both the male and female connectors 14 and 16 with equal efficacy, such as square, octagon, other parallelepiped shapes, and/or other non-symmetrical shapes.

Figure 3C:
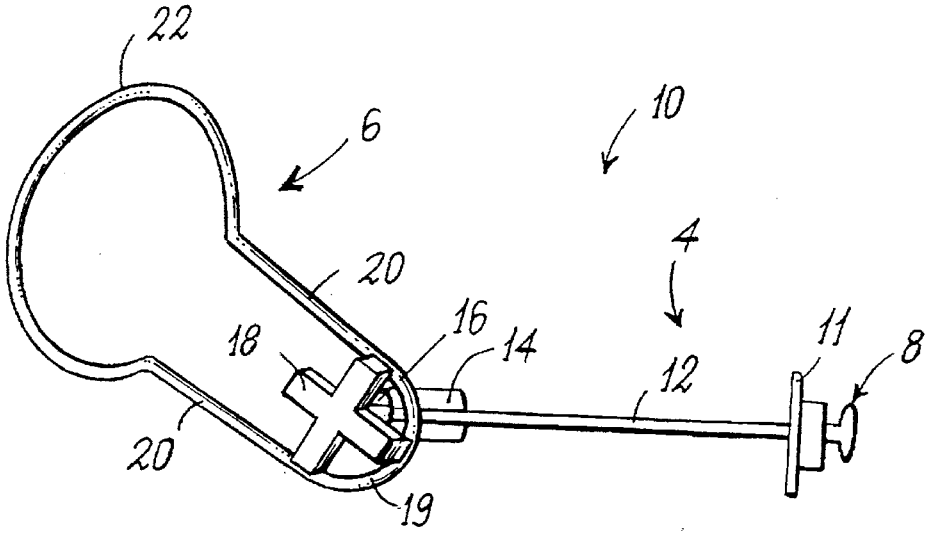
FIG. 3C is a top view of the product display apparatus of FIG. 1, arranged to display a product at an angle.

FIG. 3C is a top view of the product display apparatus 10 of FIG. 1, wherein the holder element 6 is connected to the support element 4 at an angle. In particular, the male connector 16 has been aligned with the female connector 14 in a manner to extend the holder element 6 at an angle away from the display arm 12 of the support element 4 of approximately 30 degrees. The effect of such positioning of the holder element 6 is to provide a perspective view of a product to a consumer, while still enabling the easy removal and replacement of the product.

Figure 4:
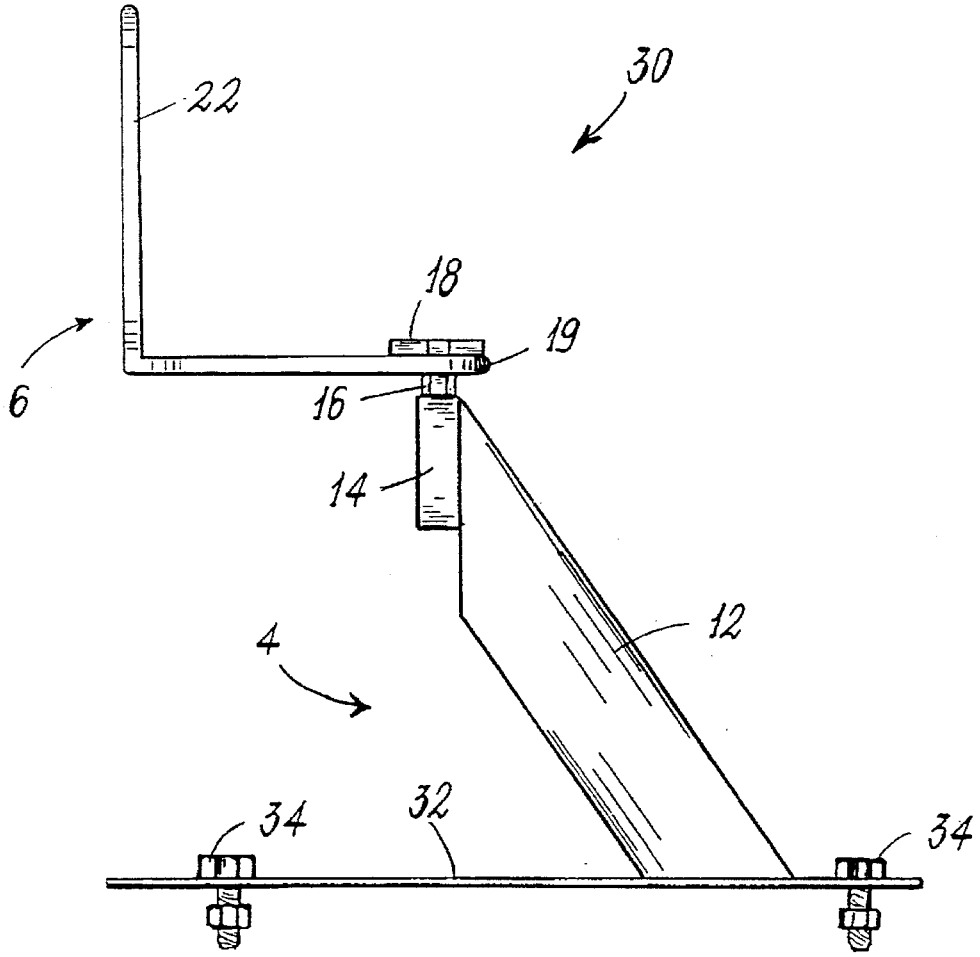
FIG. 4 is a side view of another embodiment of a product display apparatus according to the invention.

FIG. 4 is a side view of another embodiment of a product display apparatus 30 according to the invention. Where elements of the embodiment of FIG. 4 are the same or substantially the same as elements of the embodiment shown in FIG. 1, the same reference numerals are used. In particular, the support element 4 of the display apparatus 30 comprises a display bracket 32 having a set of mounting nuts and bolts 34, a display arm 12 connected to the display bracket 32, and a female connector 14. The holder element 6 comprises a male connector 16 connected to a cross-shaped support 18, which in turn is connected to a rod holder means 19 that terminates in a loop holder 22. When the holder element 6 is connected to the support element 4, the rod holder means 19 is preferably parallel to the ground Thus, the connectors 14 and 16 can be designed to permit the loop holder 22 to assume a plurality of orientations at intervals a full 360 degrees about the axis defined by the connectors 14 and 16.

The display apparatus 30 may be attached to a floor display area, or to a raised horizontal display area surface, such as a table display in a retail store. The product display apparatus 30, like the product display apparatus 10 of FIG. 1, is versatile, permitting a product to be displayed in a plurality of orientations. In addition, the display means 30 presents a product in a highly desirable manner, namely in a manner that enables a consumer to easily see fashion details of the product, and in a manner that cradles the product so that it is easy for a consumer to remove and replace. As one of skill in the art can easily appreciate, with minor design changes to the connectors 14 and 16 and to the display bracket 32, the display apparatus 30 could be attached to a ceiling or other overhead horizontal display surface.

It should be understood from the foregoing that additional objectives of the invention are to enable a retailer to favorably display products in different orientations, to provide an attractive appearance for the merchandise and to give the retailer the freedom to easily change the appearance of his displays. In particular, a product display means according to the invention may have a support arm 12 connected to a display bracket 11 at a different angle than that shown in the figures, or the female and male connectors 14 and 16 may be connected at different angles, or a combination of different angles may be used, which construction will affect the display angle of the product. Such design differences may be instituted in the construction of a display apparatus by careful consideration of the particular use and the product to be supported by the display apparatus. For example, if attachment to a horizontal table is required, then an embodiment along the lines of the display apparatus 30 shown in FIG. 4 should be used.

One of skill in the art understands that the placement of the male and female connectors 14 and 16 of the embodiments described herein may be interchanged with one another, and also may comprise other types of removably attachable connectors. In addition, the rod holder means 19 and cross-shaped support 18 may be replaced by a flat, one piece bar support means or other design which may depend upon the type of product to be displayed. Further, it is contemplated that the circular loop holder 22 may be of other shapes that may better conform to other product types to be displayed.

It should also be understood that other products besides footwear could be displayed by a display apparatus according to the invention. In order to support other products, the loop holder 22 and/or the rod holder means 19 and/or the cross-shaped element 18 could be modified. Thus, although the present invention has been described in connection with preferred embodiments and in the context of displaying footwear, many other variations and modifications will be apparent to those skilled in the art which will fall within the scope of the appended claims.

I claim:

1. A product display apparatus, comprising:

a support element having a display bracket with at least one connection means for attachment to a display area surface, a display arm attached to the display bracket at its first end and to a female connector at its second end, wherein the female connector contains a plurality of internal spaced apart longitudinal ridges; and a product holder element comprising a male connector at its first end, the male connector shaded such that it removably mates with the female connector in a plurality of orientations, and a product holder means at its second end for supporting a product, wherein the product may be displayed in a number of different orientations depending upon how the male and female connectors are aligned.

2. The display apparatus of claim 1, wherein the connection means comprises at least one clamping device.

3. The display apparatus of claim 1, wherein the connection means comprises at least one nut and bolt.

4. The display apparatus of claim 1, wherein the product holder means comprises two parallel rods terminating in a loop for supporting an item, wherein the loop is approximately perpendicular to the rods.

5. The display apparatus of claim 1, wherein the display arm extends from the display bracket at a downward angle of approximately 45 degrees.

6. The product display apparatus of claim 1, wherein the male connector has a hexagonal cross section.

7. The product display apparatus of claim 1, wherein the female connector contains a base which provides a stop point for the male connector.

8. A product display apparatus, comprising:

a support element having a display bracket with at least one connection means for attachment to a display area surface, and a display arm attached to the display bracket at its first end and to a male connector at its second end; and a product holder element comprising a female connector at its first end, the female connector containing a plurality of internal spaced apart longitudinal ridges for removably mating with the male connector in a plurality of orientations, and a product holder means at its second end for supporting a product, wherein the product may be displayed in a number of different orientations depending upon how the female and male connectors are aligned.

9. The display apparatus of claim 8, wherein the connection means comprises at least one clamping device.

10. The display apparatus of claim 8, wherein the connection means comprises at least one nut and bolt.

11. The display apparatus of claim 8, wherein the product holder means comprises two parallel rods terminating in a loop for supporting an item, wherein the loop is approximately perpendicular to the rods.

12. The display apparatus of claim 8, wherein the display arm extends from the display bracket at a downward angle of approximately 45 degrees.

13. The product display apparatus of claim 8, wherein the male connector has a hexagonal cross section.

14. The product display apparatus of claim 8, wherein the female connector contains a base which provides a stop point for the male connector.

* * * * *

UNITED STATES PATENT AND TRADEMARK OFFICE

CERTIFICATE OF CORRECTION

PATENT NO. : 5,662,301

DATED : September 2, 1997

INVENTOR(S) : Kambiz H. Fard

It is certified that error appears in the above-identified patent and that said Letters Patent is hereby corrected as shown below:

Col. 1, line 58, after "Fig. 2;", insert a new paragraph.

Col. 3, line 45, after "ground", insert a period --.--.

Col. 4, line 45, claim 1, cancel "shaded" and insert --shaped--.

Signed and Sealed this

Eighth Day of September, 1998

*Attest:*

*Attesting Officer*

Bruce Lehman

BRUCE LEHMAN

*Commissioner of Patents and Trademarks*